United States Patent [19]

Tufte, Jr.

[11] 4,272,116

[45] Jun. 9, 1981

[54] APPARATUS AND METHOD OF DISPOSING OF PET WASTE AND THE LIKE

[76] Inventor: Ralph W. Tufte, Jr., 5820 S. 100 Plz., 3B, Omaha, Nebr. 68127

[21] Appl. No.: 94,853

[22] Filed: Nov. 16, 1979

[51] Int. Cl.[3] ..... A01K 29/00; A47L 13/52

[52] U.S. Cl. ..... 294/1 B; 15/257.1

[58] Field of Search ..... 294/1 B, 1 BA, 1 BB, 294/55; 15/104.8, 257.1, 257.2, 257.6; 229/38, 39 R, 41 B, 43, 52 B

[56] References Cited

U.S. PATENT DOCUMENTS

| | | | |
|---|---|---|---|
| 1,990,026 | 2/1935 | Glen | 15/257.6 |
| 3,286,826 | 11/1966 | Stoll | 294/1 B |
| 3,390,804 | 7/1968 | Morgan | 15/257.1 X |
| 3,417,911 | 12/1968 | Hennessey | 229/52 B X |
| 3,765,044 | 10/1973 | Hanahan et al. | 15/104.8 |
| 3,790,066 | 2/1974 | Malinowski | 229/52 B |
| 4,017,015 | 4/1977 | Jefferson | 294/1 B |

FOREIGN PATENT DOCUMENTS

| | | | |
|---|---|---|---|
| 1021750 | 3/1966 | United Kingdom | 15/257.2 |

*Primary Examiner*—Johnny D. Cherry
*Attorney, Agent, or Firm*—Zarley, McKee, Thomte, Voorhees & Sease

[57] ABSTRACT

An apparatus for disposing of pet waste and the like includes a collapsible generally rectangular container having an open forward end and an integral handle by which an operator may support and manipulate the container without contacting either the container or waste material. A separate spatula may be provided for moving waste material into the container. Both the container and spatula may be provided with a coacting connection operative for securing the spatula in substantially closed relation over the forward end of the container. The method of the present invention includes placing a container adjacent the waste material, manipulating a spatula to move the waste material into the container, covering the open forward end of the container with the spatula and securing the same thereon and disposing of the container, waste material and spatula as a unit.

11 Claims, 5 Drawing Figures

APPARATUS AND METHOD OF DISPOSING OF PET WASTE AND THE LIKE

BACKGROUND OF THE INVENTION

The present invention is directed generally to an apparatus and method for disposing of pet waste and the like and more particularly to an improved apparatus and method by which pet waste and the like may be easily picked up, carried and disposed of without soiling one's hands.

Due to the increasing pet population nationwide, certain large cities such as San Francisco and New York have adopted ordinances requiring that pet owners clean up after their pets. Even in areas where such cleanliness is not prescribed by ordinance, it is desireable to dispose of pet waste and the like in order to maintain attractive lawns which are safe to walk on without soiling one's shoes. Accordingly, there is a need for an improved means of picking up and disposing of such waste material.

The known devices which have been provided for this purpose each have various shortcomings. The most common device is a somewhat forked shovel wherein the forks are directed generally perpendicular to the handle thereof. This device, however, is soiled with each use and must be carried back to its storage location in order to be available the next time it is needed. Another tool provides a metal container pivotally supported at the end of an elongated handle with disposable liners being provided for the container. While the liner prevents direct contact with the waste material, one's hands still may be soiled when removing the liner from the container. Other devices include disposable boxes, one having a hinged cover and the other an extended bottom wall. It is difficult, however, to manipulate such disposable boxes to pick up the waste material without the aid of a separate shovel or the like which thus becomes soiled and must be carried home for future use. All of the problems referred to above are resolved by the apparatus and method of the present invention.

Accordingly, it is a primary object of the invention to provide an improved apparatus and method for disposing of pet waste and the like.

Another object is to provide a pet waste collector apparatus which is disposable.

Another object is to provide a pet waste collector apparatus which is collapsible.

Another object is to provide an improved apparatus and method for disposing of pet waste which substantially eliminates the chance of soiling one's hands during use.

Finally, an object is to provide an improved pet waste disposal apparatus which is simple in construction, economical to manufacture and simple and efficient in operation.

SUMMARY OF THE INVENTION

The apparatus for disposing of pet waste and the like according to the present invention includes a disposable generally rectangular container having a bottom wall, top wall and opposite sidewalls which are foldingly interconnected so that the container is foldable from a substantially planar collapsed form to a generally tubular open form. A back wall is foldingly connected to one of the walls for closing the rearward end of the container and maintaining the same in its open form. A handle is integrally formed with one of the walls so that the container may be supported and manipulated by the handle portion. Accordingly, the chance of an operator soiling his hands is substantially eliminated since the handle frees the operator from direct contact with even the walls of the container into which the waste material is inserted. Because the container is collapsible, it is easily carried to the site of use such as a city park and because it is disposable, there is nothing to carry home.

The invention further contemplates a disposable spatula adapted for moving waste material into the container. The spatula and container may be provided with coacting connector means so that the spatula may be secured in closed relation over the open forward end of the container after waste material is inserted into it. Accordingly, no permanent tool such as a shovel is necessary yet the shovel function may be performed by the disposable spatula to easily and efficiently pick up the waste material. When secured over the forward end of the container, the spatula maintains the waste material into the container until the container, spatula and waste material can all be disposed of as a unit.

The method of disposing of waste material according to the invention therefore includes the steps of placing the container adjacent the waste material, manipulating the spatula to move waste material into the container, securing the spatula onto the open forward end of the container and disposing of the container, waste material and spatula as a unit.

DESCRIPTION OF THE PREFERRED EMBODIMENT

Figure 1:
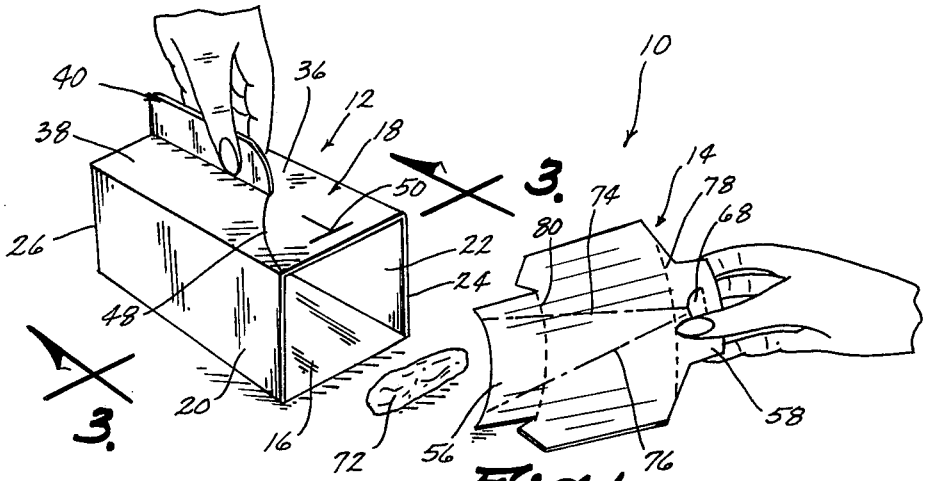
FIG. 1 is a perspective view of the container and spatula of the invention during use.
Figure 2:
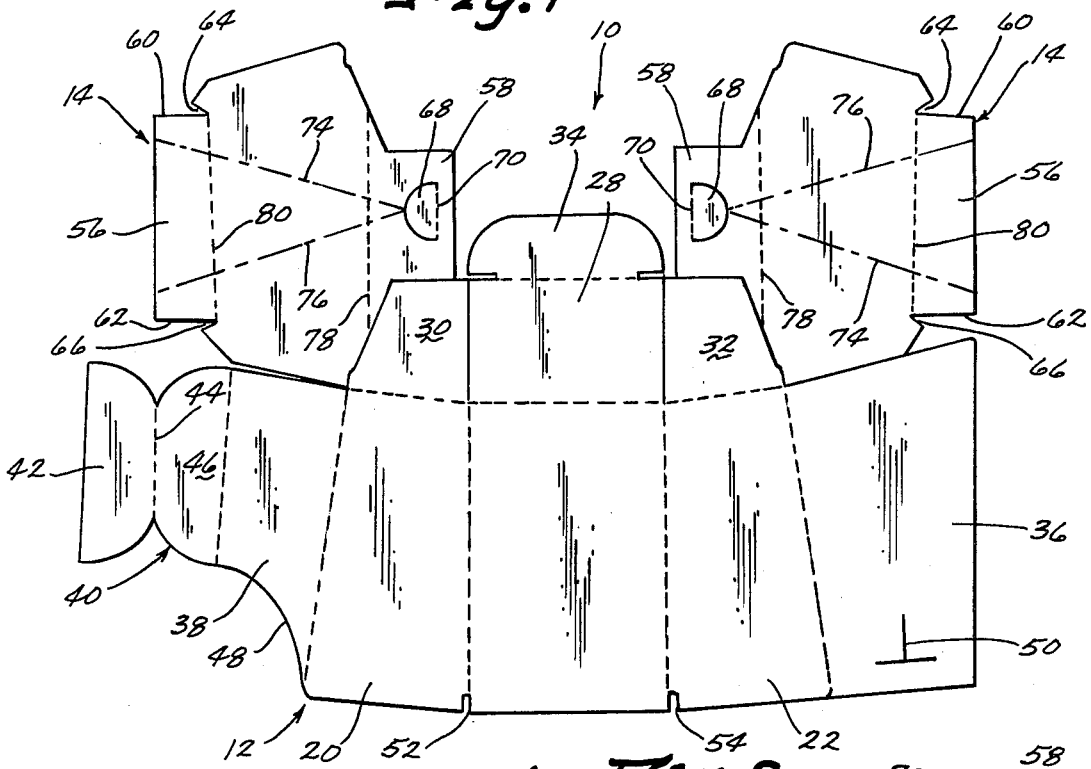
FIG. 2 is a top plan view of the blank from which the container and spatula of the invention are constructed.

The disposable pet waste collector of the present invention, indicated generally at 10 in FIG. 1, includes a collapsible and generally rectangular container 12 and a cooperating spatula 14. The container and spatula have complementary shaped edges which enable them to be stamped as a single blank as indicated in FIG. 2 wherein it can be seen that a second container 12 may be arranged in inverted relation above the container that is shown so that the cutting of blanks for a pair of containers and spatulas makes very efficient use of stock material.

Figure 3:
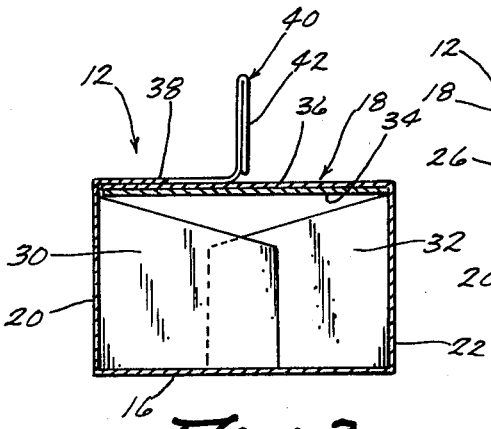
FIG. 3 is a partially sectional front view of the container as seen on line 3—3 in FIG. 1.

Container 12 includes a bottom wall 16, a top wall 18 and opposite sidewalls 20 and 22. Together these walls form a tubular enclosure having an open forward end 24 and a rearward end 26 adapted to be closed by a back wall 28 which is foldingly connected to the rearward end of bottom wall 16. Likewise, sidewalls 20 and 22 are provided with closure flaps 30 and 32 respectively which are adapted to be folded interiorly of back wall 28 when an insert tab 34 on back wall 28 is inserted below top wall 18 as shown in FIG. 3.

The container top wall 18 is formed from first and second portions 36 and 38 and includes an integral handle 40 extended upwardly therefrom. The first portion 36 of top wall 18 is foldingly connected to sidewall 22 and extends substantially across the container in its open form. Second portion 38 is foldingly connected to the opposite sidewall 20 and extends across the container approximately to the center thereof in overlapping relation to first portion 36 to which it is secured by an adhesive or any other suitable means.

Handle 40 comprises an upturned end of the top wall second portion 38 and includes an upper portion 42 folded over along a line 44 into engagement with a lower portion 46 so as to form a double thickness handle.

In the preferred embodiment, handle 40 is positioned centrally of top wall 18 along a longitudinal center line extended from rearward end 26 toward forward end 24.

To accommodate spatula 14 in a manner described hereinbelow, the top wall second portion 38 has its forward end cut back in an arcuate shape as at 48 to expose the underlying first portion 36 which includes a generally T-shaped slot 50, as seen in FIGS. 1 and 2. Likewise, sidewalls 20 and 22 are provided with slots 52 and 54 which are positioned adjacent bottom wall 16.

Figure 4:
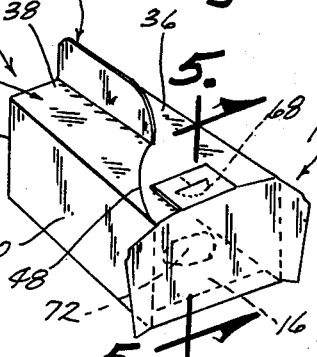
FIG. 4 is perspective view of the container showing the spatula secured onto the forward end thereof.
Figure 5:
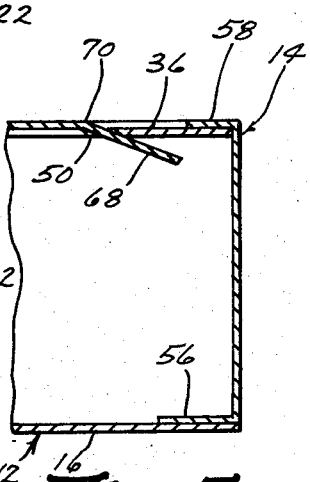
FIG. 5 is an enlarged detail sectional view taken along line 5—5 in FIG. 4.

The spatula 14 has a tongue 56 extended longitudinally from one end thereof and a tab 58 at the opposite end. The tongue 56, has side edges 60 and 62 which partially define slots 64 and 66 adapted for engagement with the slots 52 and 54 in sidewalls 20 and 22 when the tongue 56 is inserted into the container along bottom wall 16. For this purpose, the width of tongue 56 between slots 64 and 66 is substantially the same as that of bottom wall 16. Likewise, tab 58 is provided with a somewhat semi-circular shaped insert 68 foldable along line 70. Insert 68 is adapted for insertion into the T-shaped slot 50 in top wall 18 when the spatula 14 is folded in closed relation over the open forward end of container 12, as shown best in FIGS. 4 and 5.

It is anticipated that the pet waste collector 10 would be provided with the portions of the handle and top wall already adhered together but with the top wall 18 and one sidewall collapsed onto bottom wall 16 and the other sidewall so that a stack of the disposable units may be stored in a minimum of space and so that the collapsed container may be easily carried in a purse, briefcase or even tucked into one's clothing. It is seen, however, that the containers could also be fully preassembled and simply inserted one within another to conserve space.

In operation, it is only necessary for the user to expand the container 12 to its open form and to fold in the closure flaps 30 and 32 before inserting the tab 34 of back wall 28 to maintain the container in its open form. The operator can then fully support and manipulate the container by handle 40 alone so that there is no chance of soiling his hands. His other hand is then free to grasp the tab end 58 of spatula 14 to scoop up the waste material 72 for insertion into the container 12 through the open forward end 24. As the waste material is inserted into the container the tongue 56 of spatula 14 is inserted to the extent of engagement between the spatula slots 64 and 66 with the container slots 52 and 54 whereupon the tab portion 58 may be simply folded upwardly over top wall 18 for setting the insert 68 within the T-shaped slot 50 to maintain the spatula in closed relation over the forward end of the container.

To strengthen the spatula, it is provided with a pair of score lines 74 and 76 which are extended generally longitudinally of the spatula 14 and along which the spatula may be folded into a somewhat channel shape. The spatula is also provided with laterally extended skip lines 78 and 80 along which the spatula is to be folded for closing the end of container 12.

Whereas the disposable waste collector of the present invention has been described in connection with the preferred embodiment shown in the drawings, it is understood that many modifications may be made without parting from the intended broad scope of the invention. For example, the back wall 28 could be foldingly connected to one of the other walls than the bottom wall and top wall 18 could be constructed as a unitary member with handle 40 constructed as an integral portion of one of the other walls of the container.

The method of disposing of pet waste material and the like according to the present invention is believed to be apparent from the above description but basically includes the steps of placing the container adjacent waste material to be disposed of, manipulating the spatula to move the waste material into the container, covering the open forward end of the container with the spatula and securing the same thereon, and finally disposing of the container, waste material and spatula as a unit. The method further contemplates supporting the container by the handle to prevent soiling of the user's hands.

Thus there has been shown and described an apparatus and method for disposing of pet waste and the like which accomplish at least all of the stated objects.

I claim:

1. A disposable collector for pet waste and the like comprising, a collapsible generally rectangular container having forward and rearward ends, a bottom wall, top wall and opposite sidewalls foldingly interconnected whereby said container is foldable from a substantially planar collapsed form to a generally tubular open form, and a back wall foldingly connected to one of said walls and adapted to close the rearward end of said container in said open form thereof, said container further comprising a handle portion formed integrally with one of said walls whereby said container may be supported and manipulated by said handle portion, a flat spatula adapted for moving waste into said container, said spatula and container including coacting connector means operative for securing said spatula in substantially closed relation over the forward end of said container, and said spatula having a pair of laterally directed score lines spaced longitudinally apart by a distance substantially equal to the height of said container at the forward end thereof whereby said spatula may be folded along said score lines to substantially conform to the forward end of said container.

2. The disposable collector of claim 1 wherein said handle portion comprises an integral extension of said top wall arranged generally centrally thereof.

3. The disposable collector of claim 2 wherein said handle portion extends upwardly from said top wall generally along a center line extended from said forward end to said rearward end.

4. The disposable collector of claim 1 wherein said top wall includes a first portion foldingly connected to one sidewall and extended substantially across said container, a second portion foldingly connected to the opposite sidewall and extended across said container approximately to the center thereof in overlapping relation to said first portion, and means for securing said first and second portions in overlapping relation.

5. The disposable collector of claim 4 wherein said handle comprises an integral upturned end of said second portion of the top wall.

6. The disposable collector of claim 1 wherein said handle has an upper portion folded over into engagement with a lower portion thereby to form a double thickness handle.

7. The disposable collector of claim 6 further comprising means for securing said upper and lower portions of said handle together in folded over engagement.

8. A disposable collector for pet waste and the like comprising, a collapsible generally rectangular container having forward and rearward ends, a bottom wall, top wall and opposite sidewalls foldingly interconnected whereby said container is foldable from a substantially planar collapsed form to a generally tubular open form, and a back wall foldingly connected to one of said walls and adapted to close the rearward end of said container in said open form thereof, said container further comprising a handle portion formed integrally with one of said walls whereby said container may be supported and manipulated by said handle portion, a spatula adapted for moving waste into said container, said spatula and container including coacting connector means operative for securing said spatula in substantially closed relation over the forward end of said container, and said coacting connector means comprising slots in the forward ends of said sidewalls adjacent said bottom wall and coacting slots in said spatula, said spatula comprising a tongue portion having a width substantially the same as said bottom wall, said tongue having side edges which partially define said spatula slots whereby said spatula slots are adapted for engagement with the slots in said sidewalls when said tongue is inserted into said container along said bottom wall.

9. The disposable collector of claim 8 wherein said coacting connector means further comprises means for securing an end of said spatula opposite said tongue to said top wall, thereby to substantially close the forward end of said container.

10. The disposable collector of claim 9 wherein said spatula includes at least a pair of spaced-apart score lines directed generally longitudinally of said tongue for folding said spatula along said score lines into a somewhat channel shape for added strength.

11. The disposable collector of claim 9 wherein said spatula further comprises a pair of laterally directed score lines spaced longitudinally apart a distance substantially equal to the height of said container at the forward end thereof whereby said spatula may be folded along said score lines to substantially conform to the forward end of said container.

* * * * *